US010016031B2

(12) United States Patent
Gubanov

(10) Patent No.: US 10,016,031 B2
(45) Date of Patent: Jul. 10, 2018

(54) METHODS AND APPARATUS FOR ADAPTABLE TRANSFORMATION OF CHAINS

(71) Applicant: Aleksey P. Gubanov, Memphis, TN (US)

(72) Inventor: Aleksey P. Gubanov, Memphis, TN (US)

(73) Assignee: GUBALINK LLC, New York, NY (US)

( * ) Notice: Subject to any disclaimer, the term of this patent is extended or adjusted under 35 U.S.C. 154(b) by 0 days.

(21) Appl. No.: 15/326,932

(22) PCT Filed: Jul. 16, 2015

(86) PCT No.: PCT/IB2015/001828
§ 371 (c)(1),
(2) Date: Jan. 17, 2017

(87) PCT Pub. No.: WO2016/020758
PCT Pub. Date: Feb. 11, 2016

(65) Prior Publication Data

US 2017/0208908 A1 Jul. 27, 2017

Related U.S. Application Data

(60) Provisional application No. 62/025,258, filed on Jul. 16, 2014.

(51) Int. Cl.

| | |
|---|---|
| ***B21L 5/02*** | (2006.01) |
| ***A44C 11/00*** | (2006.01) |
| ***A44C 5/10*** | (2006.01) |

(52) U.S. Cl.
CPC ..... *A44C 11/00* (2013.01); *A44C 5/102* (2013.01); *B21L 5/02* (2013.01)

(58) Field of Classification Search
CPC ..... B21L 5/02; A44C 11/00; A44C 5/102
(Continued)

(56) References Cited

U.S. PATENT DOCUMENTS 2,116,116 A * 5/1938 Hilliard ..... B21L 1/00 152/243
2,140,491 A * 12/1938 Biedermann ..... A44C 11/00 59/80

(Continued)

OTHER PUBLICATIONS

Real vs. Steal Celine ID Choker Necklace, http://intheircloset.com:80/celine-id-choker-necklace; Aug. 24, 2015.*

*Primary Examiner* — David B Jones
(74) *Attorney, Agent, or Firm* — Justin B. Bender, Esq.

(57) ABSTRACT

The present invention(s) seeks to protect Applicant's link, link chain and methods of making, transforming and using such. The link, for use in series to form a multi-positionable link chain includes a through hole and a first and a second diagonal channel on a top and a bottom side running in opposite directions. Generally, the geometry of the links, and specifically, material removed from and/or sharpened edges of the through hole, the diagonal channels and/or corner portions of the modified rectangular solid links, is such to allow for relative rotation and/or multiple points of connection of adjacent links. The link chains of the present invention(s) are flexible in the length, width and height dimensions to allow adaptable transformation in a plurality of stable configurations. And they can include a clasp for ornamental and/or decorative use.

25 Claims, 6 Drawing Sheets

(58) Field of Classification Search
USPC ..... 59/78, 80, 82, 2, 29
See application file for complete search history.

(56) References Cited

U.S. PATENT DOCUMENTS

| | | | | | |
|---|---|---|---|---|---|
| 2,190,129 | A | * | 2/1940 | Stahl | B21L 3/00 59/25 |
| D157,244 | S | * | 2/1950 | Dieterich | D11/22 |
| D172,332 | S | * | 6/1954 | Boots | D11/22 |
| 4,625,508 | A | * | 12/1986 | Fontana | A44C 5/105 59/80 |
| 4,996,835 | A | * | 3/1991 | Rozenwasser | A44C 11/00 59/3 |

* cited by examiner

METHODS AND APPARATUS FOR ADAPTABLE TRANSFORMATION OF CHAINS

CROSS REFERENCE TO RELATED APPLICATIONS

This application claims priority to the following commonly owned patent application, an entire copy of which is incorporated herein by reference: U.S. application Ser. No. 62/025,258, having Filing Date of 16 Jul. 2014, entitled "METHODS AND APPARATUS FOR ADAPTABLE TRANSFORMATION OF CHAINS".

BACKGROUND

Chains are well known in the art. A chain is a series of connected links that are typically made of metal. A chain may consist of two or more links. Chains have been used in countless applications for millennia that range from jewelry, transportation, support and hoisting, power transfer, etc.

Chains are usually made in one of two styles according to their intended use. Chains designed for transferring power in machines have links designed to mesh with sprockets. They are known as roller chains and travel in curved paths and sometimes are able to flex and twist with additional designed link clearances. Chains designed for lifting, such as when used with a hoist, for pulling, or for securing, have links that are torus shaped. Such chains are flexible in two dimensions, i.e. travel in curved paths and are able to flex and twist. Decorative and ornamental uses of chains as jewelry take countless forms.

Chains of the prior art are suitable for use in a variety of industries in applications that involve slow speeds and high torque, including conveyors, fans, blowers, pumps, motors, and gear boxes, among others. Flexible couplings are used to link two rotating shafts that are not aligned in order to transmit the rotational power, known as torque, from one shaft to the other. Most flexible couplings consist of two hubs and a middle assembly; each hub attaches to a shaft while the middle assembly flexes between the hubs to accommodate the misalignment of the two shafts. Flexible couplings are used in a broad range of applications, such as in motor vehicles, conveyors, escalators, agricultural, forestry and mining equipment, aeronautics, robotics and space exploration, among others.

In deed chain geometric complexity is equally as diverse as the applications in which they are used. Common to all chains of the prior art is that they designed and made specifically to retain only one neutral position and/or pattern. Chains of the prior art are suitable for their particular purposes, but they are not versatile, variable or manipulatable with ease to meet dynamically changing industrial or aesthetic needs.

Admittedly, the flex and twist inherent in chains under tension of the prior art allow variability in the length dimension. Note, however, such length variability is transient. Once flex and twist subsides chains under tension of the prior art return to their original length dimension. Chains under tension of the prior art, however, allow for no variability in dimensions of length, width and height for adaptable transformation in a plurality of stable configurations.

What is needed is chains that are flexible in the length, width and depth dimensions to allow adaptable transformation.

SPECIFICATION

The present invention(s) seeks to protect Applicant's link, link chain and methods of making, transforming and using such. The link, for use in series to form a multi-positionable link chain includes a through hole and a first and a second diagonal channel on a top and a bottom side running in opposite directions. Generally, the geometry of the links, and specifically, material removed from and/or sharpened edges of the through hole, the diagonal channels and/or corner portions of the modified rectangular solid links, is such to allow for relative rotation and/or multiple points of connection of adjacent links. The link chains of the present invention(s) are flexible in the length, width and height dimensions to allow adaptable transformation in a plurality of stable configurations. And they can include a clasp for ornamental and/or decorative use.

The invention(s) of the present application may be described by way of example only with reference to the accompanying drawings, of which:

Figure 1A:
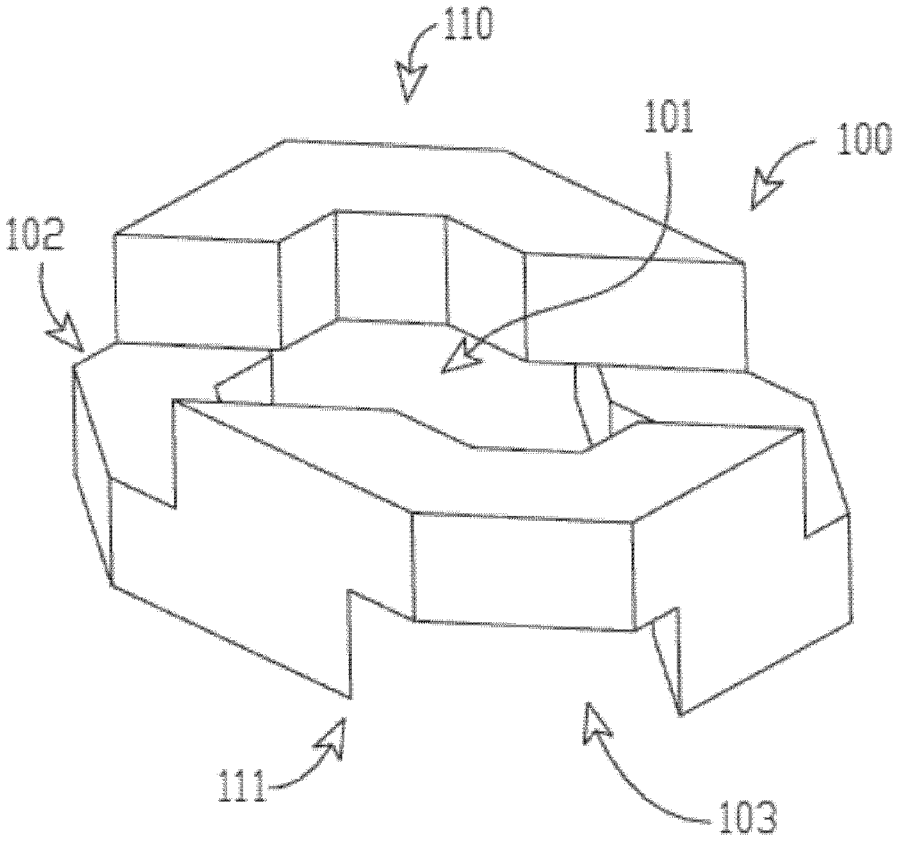
FIG. 1A is a top perspective view of a link 100.
Figure 1B:
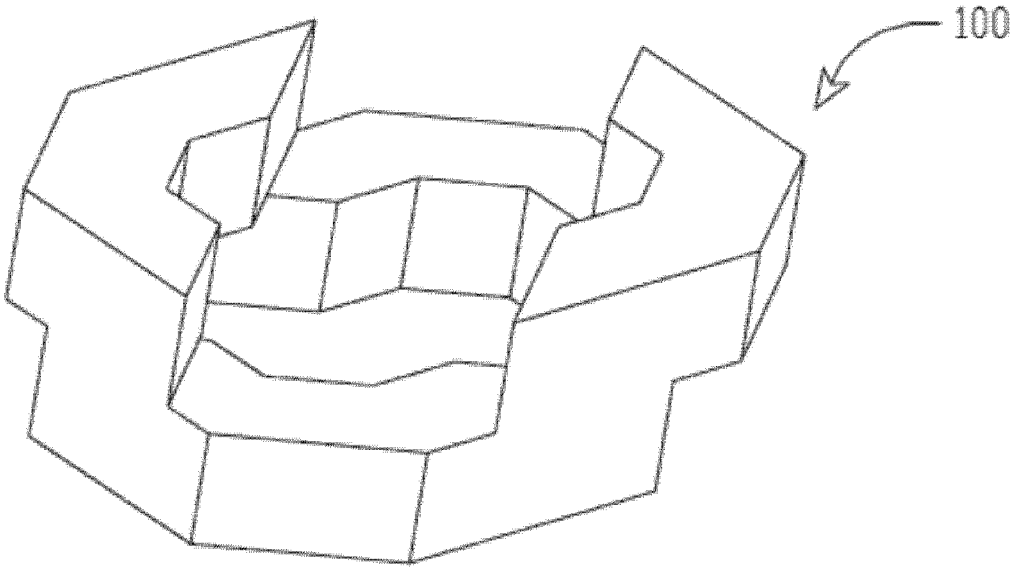
FIG. 1B is a bottom perspective view of link 100.
Figure 1C:
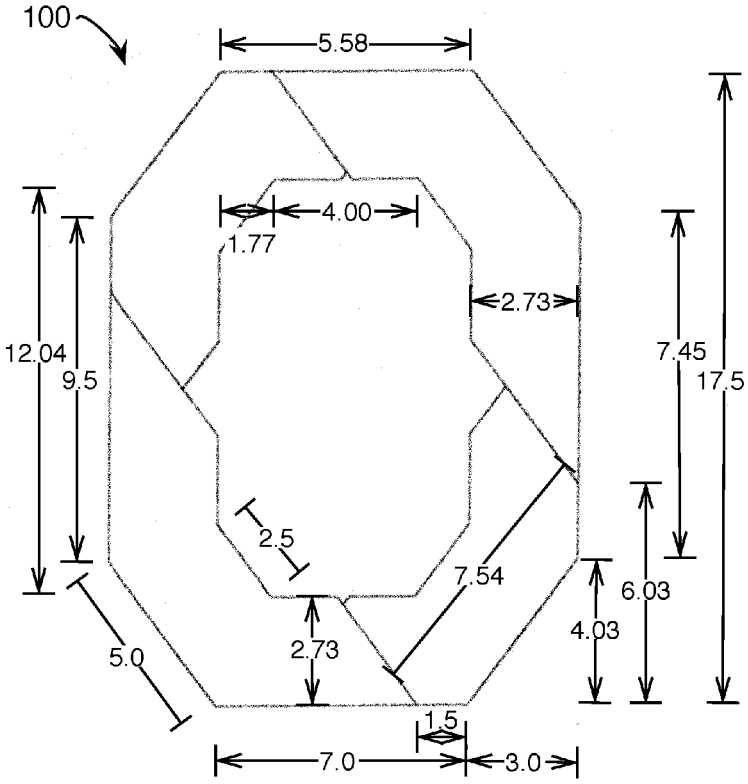
FIG. 1C is a top view of link 100.
Figure 1D:
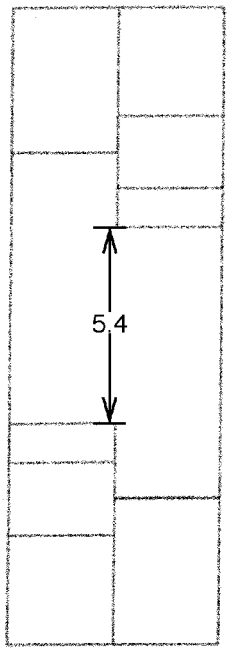
FIG. 1D is a side view of link 100.
Figure 1E:
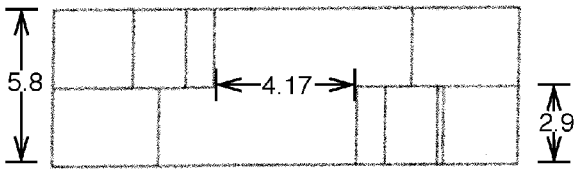
FIG. 1E is a front view of link 100.

Referring to FIGS. 1A, 1B, 1C, 1D and 1E, by way of example, link chains 1 include a series of individual links 100. Link 100 has a modified, stretched, octagonal shaped solid geometry. FIGS. 1A and 1B show a top perspective view and a bottom perspective view, respectively, of link 100. Link 100 includes a through octagonal-shaped hole 101 and a first and a second diagonal channel 102 and 103 on a top and a bottom side 110 and 111 in running opposite directions. FIGS. 1C, 1D and 1E show a top, a side and a front view of link 100.

Shapes, sizes and dimensions are shown with respect to link 100 for purposes of explanation only. Dimensions shown in FIGS. 1C, 1D and 1E are in millimeters. Modifications in shape, size and dimension may be made according to need. Generally, the inside shape of chain link 100 is a convex or concave octagon. As links 100 rotate, changes in length, width and height dimensions occur. These changes depend on the difference between the dimensions of the inside walls of links 100 as well as their thickness, or height. Generally, diagonal channels 102 and 103 are approximately 60% of the width and approximately 50% of the height of the modified rectangular solids of links 100. Generally the geometry of links 100, and specifically, material removed from and/or the sharpened edges of the corner portions, the through hole and/or the diagonal channels of the modified rectangular solids of links 100 allow for relative rotation and/or multiple points of connection of adjacent links. Just as shape, size and dimension may vary, so may material, such that any particular application suitable material may be used.

When viewed from top side 110, first diagonal channel 102 on top side 110 is cut substantially from northwest to southeast and is substantially concave and second diagonal channel 103 on bottom side 11 is cut substantially from southwest to northeast and is substantially convex. When viewed from bottom side 111, first diagonal channel 103 on top side 110 is cut substantially from southwest to northeast and is substantially convex and second diagonal channel 103 on bottom side 111 is cut substantially from northwest to southeast and is substantially concave. In another embodiment of links of the present invention, when viewed from the top side, the first diagonal channel on the top side is cut substantially from southwest to northeast and is substantially concave and the second diagonal channel on the bottom side is cut substantially from northwest to southeast and is substantially convex. When viewed from the bottom side, the first diagonal channel on the top side is cut substantially from northwest to southeast and is substantially convex and the second diagonal channel on the bottom side is cut substantially from southwest to northeast and is substantially concave.

Figure 2A:
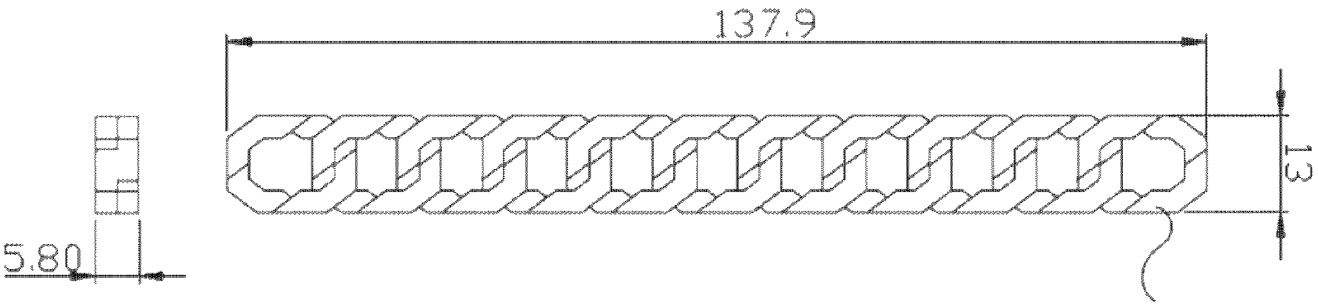
FIG. 2A is top view of a link chain 1'.
Figure 3A:
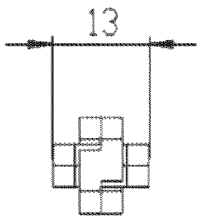
FIG. 3A is top view of a link chain 1"
Figure 4A:
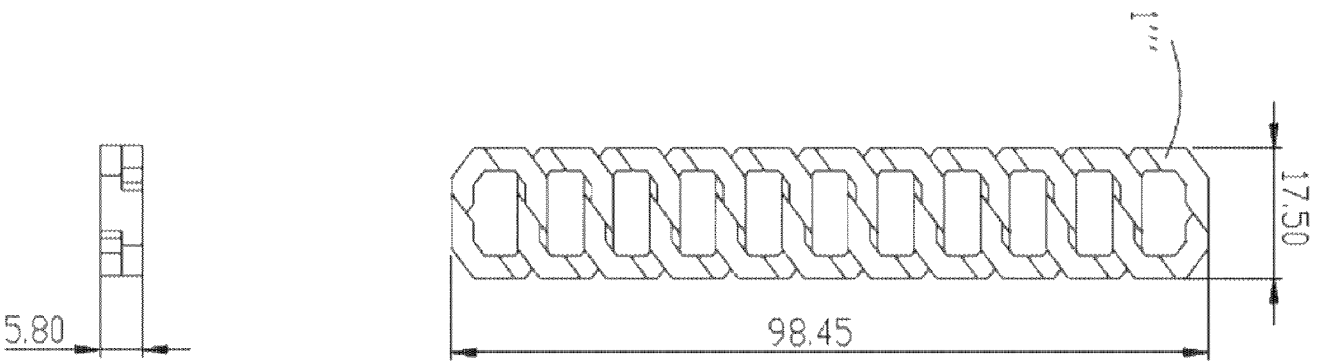
FIG. 4A is top view of a link chain 1'"

Referring to FIGS. 2A, 3A and 4A, by way of example, show link chains 1', 1" and 1'" of the present invention, respectively, which allows for transformation to take place upon twisting in a counterclockwise direction. The magnitude of applied counterclockwise turn determines the magnitude of change in the structure.

FIGS. 2A, 3A and 4A show chains 1', 1" and 1'" each having eleven (11) links 100. Using the dimensions of FIGS. 1C, 1D and 1E, it is plain to see the substantial geometric transformations of chain 1. In FIG. 2A, chain 1' has dimensions 137.9 mm by 13 mm by 5.8 mm. In FIG. 3A, chain 1" has dimensions 105 mm by 13 mm by 13 mm. And in FIG. 4A, chain 1'" has dimensions 98.4 mm by 17.5 mm by 5.8 mm. Generally first position is longer than second position and second position is longer than third position. Third position is wider than both first and second positions, which are equally as wide. Second position is deeper than both first and third positions, which are equally as deep. Specifically, chain 1" has approximately 80% of the length of chain 1'. Chain 1'" has approximately 75% of the length of chain 1'. Conversely, chain 1' has the same width as chain 1". Chain 1' has approximately 75% of the width of chain 1'". And chains 1' and 1'" have approximately 45% of the depth of chain 1".

Multi-positionable link chains of the present invention(s) may include either two or a series of links 100. Again the geometry of links 100 is such that adjacent links rotate relative to and/or within each other. In the case of two connected links 100, they are rotatable relative to and/or within each other in to either a first position, a second position or a third position. In the case of three connected links 100, they are rotatable relative to and/or within each other in to either first position, second position, third position, subsets and/or combinations thereof. Whereas in the case of four or more connected links 100, they are rotatable relative to and/or within each other in to either first position, second position, third position, all, subsets and/or combinations thereof.

Figure 3B:
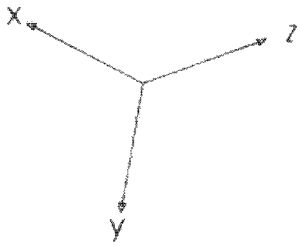
FIG. 3B is a first perspective view of link chain 1"
Figure 3B:
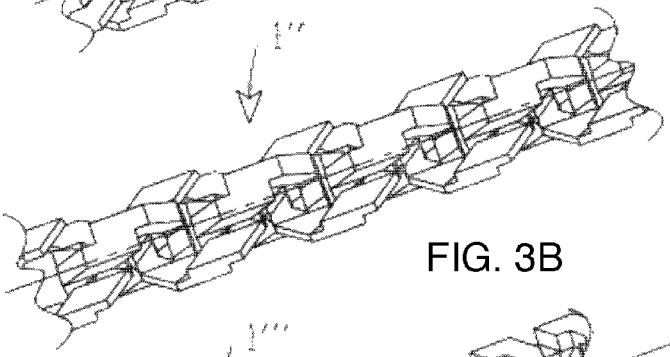
Figure 4B:
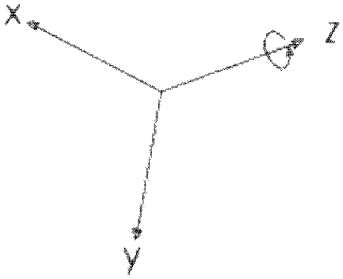
FIG. 4B is a perspective view of link chain 1'"
Figure 4B:
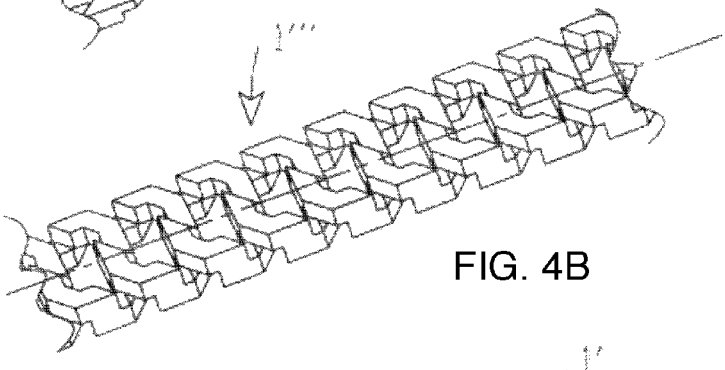
Figure 5:
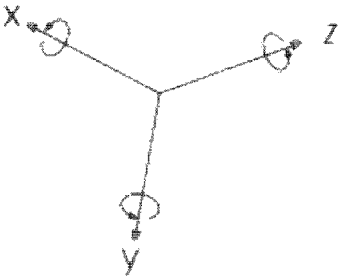
FIG. 5 is a perspective view of a hybrid of link chains 1', 1" and 1'".
Figure 5:
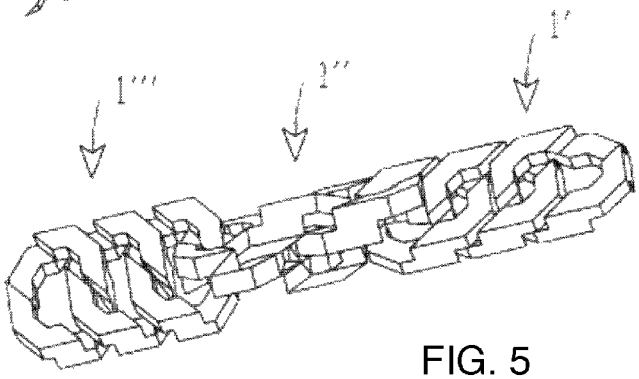
Figure 3C:
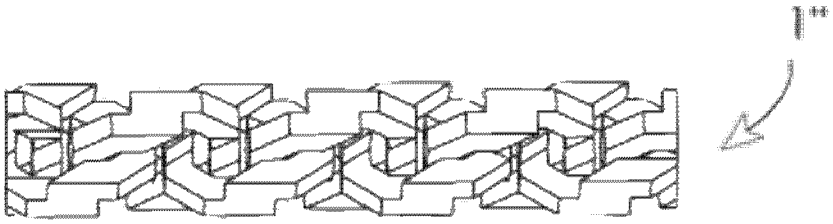
FIG. 3C is a second perspective view of link chain 1"
Figure 4C:
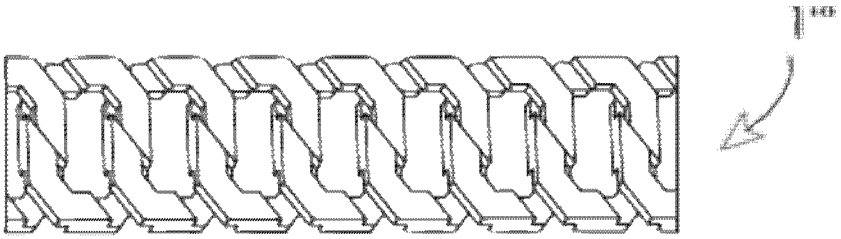
FIG. 4C is a perspective view of a link chain 1'" expanded under tension.
Figure 4D:
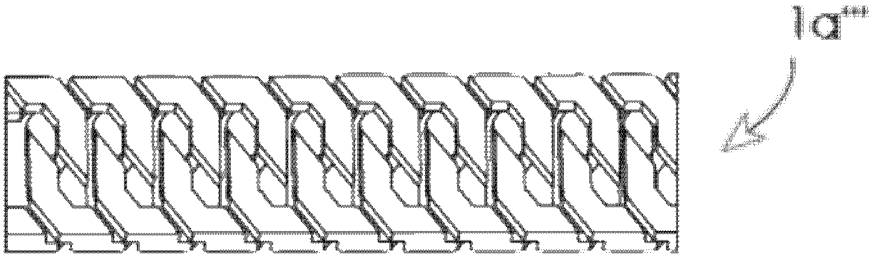
FIG. 4D is a perspective view of a compressed link chain 1'"

Referring to FIGS. 2B, 3B, 4B and 5, first position, as in 1', is achieved when a lower end of a first link 100 and an upper end of a second link 100 are adjacent. Second position, as in 1", is achieved when a lower end of a first link 100 and a right side of a second link 100 are adjacent. And third position, as in 1'", is achieved when a left side of a first link 100 and a right side of a second link 100 are adjacent. FIG. 5 shows a hybrid link chain 100 having all three positions.

Figure 2B:
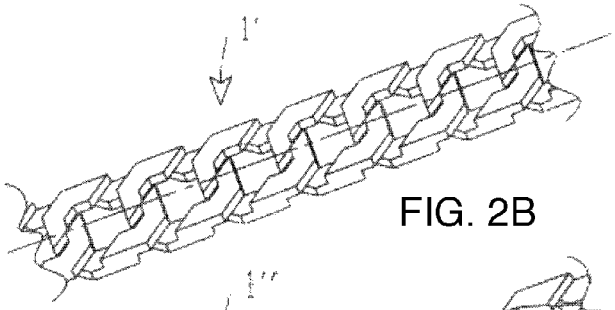
FIG. 2B is a perspective view of link chain 1'.

Generally first, second and third positions are achieved by relative rotation of connected upper and lower links 100. Link chain 1' of FIG. 2B is converted into link chain 1" of FIG. 3B when a lower link 100 is rotated 90° in a counterclockwise direction along a depth z axis relative to an upper link 100. Link chain 1" of FIG. 3B is converted into link chain 1'" of FIG. 4B when a lower link 100 is rotated 90° in a counterclockwise direction along a horizontal x axis, a vertical y axis and the depth z axis, all relative to the upper link 100. Further, link chain 1'" of FIG. 4B is converted into link chain 1" of FIG. 3B when a lower link 100 is rotated 90° in the counterclockwise direction along the horizontal x axis, the vertical y axis and the depth z axis, all relative to the upper link 100. Link chain 1" of FIG. 3B is converted into link chain 1' of FIG. 2B when a lower link 100 is rotated 90° in the counterclockwise direction along the depth z axis, relative to the upper link 100.

Note that the direction of relative rotation of connected links of the present invention(s) is relative to the direction of the channels. In the case of the second embodiment of link 100 described above, these positions are achieved by clockwise rotation.

Link chains of the present invention(s): are freely transferrable between either first position, second position, third position, all, subsets, combinations thereof; allow for relative rotation and/or multiple points of connection of adjacent links; are flexible in the length, width and height dimensions to allow adaptable transformation in a plurality of stable configurations.

Methods of making link chains 1 of the present invention(s) include: providing a rectangular solid; forming a through hole in the rectangular solid; forming diagonal channels on the top and bottom sides running in opposing directions; removing material from corner portions of the modified rectangular solid; enlarging the through hole; widening and deepening the diagonal channels; and/or repeating once or a plurality of times. Note that removing additional material from the corner portions of the modified rectangular solid, and/or sharpening the edges of the through hole, the diagonal channels and/or the corner portions of the modified rectangular solid may be performed.

Methods of making link chains 1 of the present invention(s) include: connecting two or more links 100.

FIGS. 2C, 2D, 3C, 4C and 4D indicate the relative stability of link chains 1 of the present invention(s). Generally second position is less stable than both first and third positions, which are substantially equally as stable.

Figure 2C:
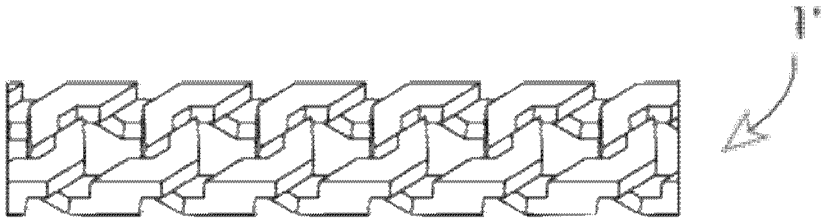
FIG. 2C is a perspective view of a link chain 1' expanded under tension.
Figure 2D:
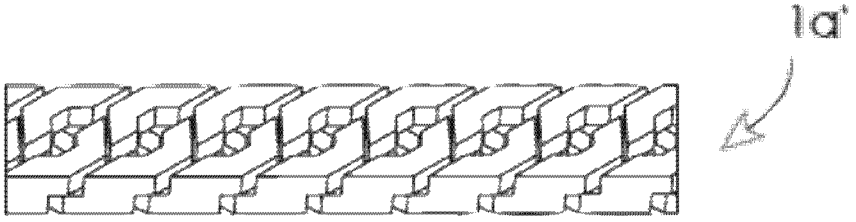
FIG. 2D is a perspective view of a compressed link chain 1'.
Figure 2E:
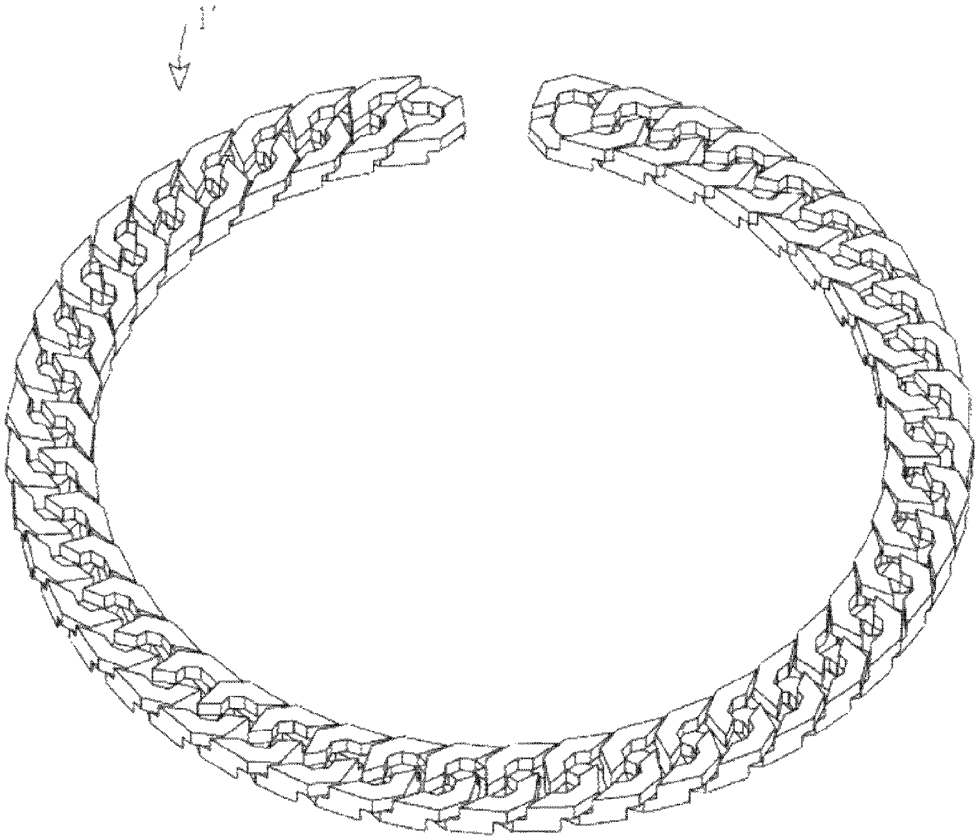
FIG. 2E is a perspective view of an ornamental link chain 1'.
Figure 4E:
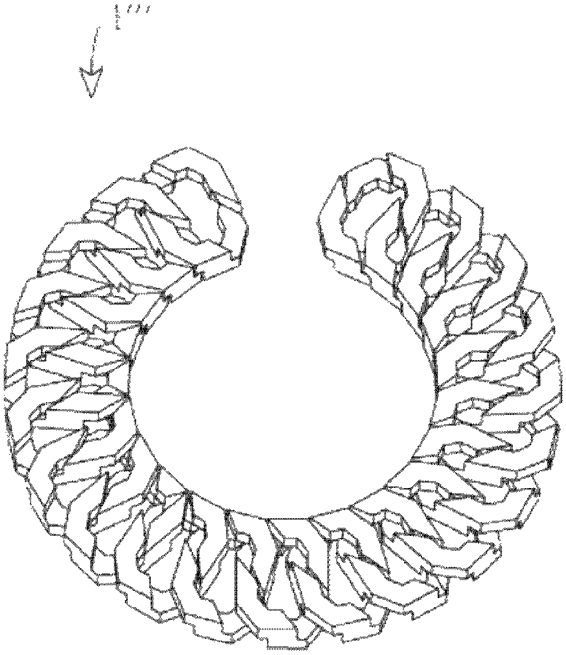
FIG. 4E is a perspective view of an ornamental link chain 1'"

The residential, commercial and industrial applications for chain 1 are endless, indeed any application in which a chain is used. Referring to FIGS. 2E and 4E, link chains 1 also serves as versatile, variable and manipulatable items of jewelry including a clasp for ornamental and/or decorative use. Discussion applicable to jewelry and aesthetics includes the following. Chains 1 relate generally to the traditional Cuban link chain. Applicant markets chain 1 under the trade name GUBALINK™, named after its inventor. GUBALINK™ is able to transform shape and therefore position through turning of links 100 along the length, width and depth axes. This can be done link by link, groups of links by groups of links, or any subset or combination thereof. Users also can hold the chain by its ends and twist either clockwise or counterclockwise. FIG. 5 shows the versatility of chain 1 for any mood and/or occasion and includes portions of chains 1', 1" and 1'". Chain 1, when used as jewelry, is versatile.

Traditional decorative and/or ornamental links and link chains fail to transform according to shifts in moods and occasions. The plurality of stable and semi-stable positions made available by GUBALINK™, allows its wearer to express personal style and taste and move effortlessly between formal, casual, rugged, edgy, marine, etc., moods and occasions, as they change. Indeed GUBALINK™ provides customization according to occasion, which increases its utility and value.

Admittedly, the flex and twist inherent in chains under tension of the prior art allow variability in the length dimension. Note, however, such length variability is transient. Once flex and twist subsides chains under tension of the prior art return to their original length dimension. Chains under tension of the prior art, however, allow for no variability in dimensions of length, width and height for adaptable transformation in a plurality of stable configurations. Link chains 1 of the present invention(s) are flexible in the length, width and depth dimensions to allow adaptable transformation.

It will be understood that each of the elements described above, or two or more together, may also find a useful application in other types of constructions differing from the types described above. The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

While the invention has been illustrated and described as embodied in residential, commercial, industrial, and decorative arts, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

When used in this specification and claims, the terms "comprising", "including", "having" and variations thereof mean that the specified features, steps or integers are included. The terms are not to be interpreted to exclude the presence of other features, steps or components.

What is claimed is:

1. A link for use in series to form a multi-positionable link chain, the link including:

solid having a through hole;

a first diagonal channel through a top portion of the link;

a second diagonal channel through a bottom portion of the link;

wherein the first and the second channels run in substantially opposite directions; and where the solid, through hole and diagonal channels allow for relative rotation and/or multiple points of connection of adjacent links.

2. A link according to claim 1 having an elongated octagonal shape.

3. A link according to claim 1 including:

wherein, when viewed from a top side, the first diagonal channel through the top portion is cut substantially from northwest to southeast and is substantially concave and the second diagonal channel through the bottom portion is cut substantially from southwest to northeast and is substantially convex; and wherein, when viewed from a bottom side, the first diagonal channel through the top portion is cut substantially from southwest to northeast and is substantially convex and the second diagonal channel through the bottom portion is cut substantially from northwest to southeast and is substantially concave.

4. A link according to claim 1 including:

wherein, when viewed from a top side, the first diagonal channel through the top portion is cut substantially from southwest to northeast and is substantially concave and the second diagonal channel through the bottom portion is cut substantially from northwest to southeast and is substantially convex; and wherein, when viewed from a bottom side, the first diagonal channel through the top portion is cut substantially from northwest to southeast and is substantially convex and the second diagonal channel through the bottom portion is cut substantially from southwest to northeast and is substantially concave.

5. A link according to claim 1 wherein the diagonal channels are approximately 60% of the width and approximately 50% of the height of the solid.

6. A link according to claim 1 having sharpened edges and corners which allow for relative rotation and/or multiple points of connection of adjacent links.

7. A link according to claim 1 having an elongated polygonal shape of three or more sides.

8. A link according to claim 1 having either a rounded, circular or oval shape.

9. A multi-positionable link chain including two connected links, each having:

an elongated solid;

a through hole of similar elongated shape;

a first diagonal channel cut through a top portion of the link;

a second diagonal channel through a bottom portion of the link; and wherein the first and the second channels run in substantially opposite directions.

10. A link chain according to claim 9 including three or more of the connected links.

11. A link chain according to claim 9 including either:

two connected links such that they are rotatable relative to each other along their diagonal channels in to either a first position, a second position or a third position;

three connected links such that they are rotatable relative to each other along their diagonal channels in to either the first position, the second position, the third position, subsets and/or combinations thereof; and/or four connected links such that they are rotatable relative to each other along their diagonal channels in to either the first position, the second position, the third position, all, subsets and/or combinations thereof.

12. A link chain according to claim 11 wherein the direction of relative rotation of the connected links is relative to the direction of the channels.

13. A link chain according to claim 11 wherein the direction of rotation of the connected links is counterclockwise.

14. A link chain according to claim 11 wherein the direction of rotation of the connected links is clockwise.

15. A link chain according to claim 11 including:

wherein a length of the link chain in the first position is longer than a length of the link chain in the second position and the length of the link chain in the second position is longer than a length of the link chain in the third position;

wherein a width of the link chain in the third position is wider than both a width of the link chain in the first position and a width of the link chain in the second position, which are equally as wide; and wherein a height of the link chain in the second position is taller than both a height of the link chain in the first position and a height of a link chain in the third position, which are equally as tall.

16. A link chain according to claim 11 wherein a tensioned link chain in the second position is less stable than both a tensioned link chain in the first position and a tensioned link chain in the third position, which are substantially equally as stable.

17. A link chain according to claim 11 including:

wherein the first position is achieved when a lower end of the first link and an upper end of the second link of two connected links are adjacent;

wherein the second position is achieved when a lower end of the first link and a right side of the second link of two connected links are adjacent; and wherein the third position is achieved when a left side of the first link and a right side of the second link of two connected links are adjacent.

18. A link chain according to claim 11 including either:

connected links in the first position wherein the second position is achieved when the lower link is rotated in either a clockwise or a counterclockwise direction along a depth (z) axis relative to the upper link;

connected links in the second position wherein the third position is achieved when the lower link is rotated in either a clockwise or counterclockwise direction along a horizontal (x) axis, a vertical (y) axis and a depth (z) axis, all relative to the upper link;

connected links in the third position wherein the second position is achieved when the lower link is rotated in either a clockwise or counterclockwise direction along a horizontal (x) axis, a vertical (y) axis and a depth (z) axis, all relative to the upper link;

connected links in the second position wherein the first position is achieved when the lower link is rotated in either a clockwise or counterclockwise direction along a depth (z) axis relative to an upper link; and/or all, subsets and/or combinations thereof.

19. A link chain according to claim 11 wherein the first, the second and the third positions are achieved by relative rotation of the connected links.

20. A link chain according to claim 11 freely transferrable between either the first position, the second position, the third position, all, subsets and/or combinations thereof.

21. A link chain according to claim 11 having sharpened edges and corners which allow for relative rotation and/or multiple points of connection of adjacent links.

22. A link chain according to claim 11 flexible in a length, a width and a height dimension to allow adaptable transformation in a plurality of stable under tension configurations.

23. A link chain according to claim 9 wherein the links having an elongated octagonal shape.

24. A link chain according to claim 9 wherein the links having an elongated polygonal shape of three or more sides.

25. A link chain according to claim 9 wherein the links having either a rounded, circular or oval shape.

* * * * *